United States Patent [19]

Ransom

[11] Patent Number: 4,854,217

[45] Date of Patent: Aug. 8, 1989

[54] BREECH LOCK FOR FIREARMS

[76] Inventor: Charles R. Ransom, 134 South Horizon Cir., Prescott, Ariz. 86302

[21] Appl. No.: 158,783

[22] Filed: Feb. 22, 1988

[51] Int. Cl.[4] ..... F41C 5/06

[52] U.S. Cl. ..... 89/163

[58] Field of Search ..... 89/163, 196

[56] References Cited

U.S. PATENT DOCUMENTS 896,496 8/1908 Whiting ..... 89/163

4,222,308 9/1980 Arnett ..... 89/163

*Primary Examiner*—Stephen C. Bentley

*Attorney, Agent, or Firm*—Evanns & Walsh

[57] ABSTRACT

An improved breech lock adapted for locking the barrel and slide of a handgun together to provide for improved securement between these parts. Typically, the firearm is of the type having a slide and a relatively movable barrel along with a handgrip and trigger. The rear part of the barrel has an end configuration or conformation which cooperates with an opening or recess in the upper part of the slide. In the preferred form, the barrel has an end conformation, the forward part of which is shaped as a point configured to be received snugly in a V-shaped opening in the forward end of the recess in the slide. The breech lock provides for locking as between the slide and the barrel, preventing relative foward movement of the barrel with respect to the slide and further locking with respect to relative lateral movement as between the parts or vibration which could effect the accuracy of the firearm.

2 Claims, 2 Drawing Sheets

BREECH LOCK FOR FIREARMS

BACKGROUND OF THE INVENTION

1. Field of the Invention

The field of the invention is that of firearms and, more particularly, the type of firearm which is a handgun having a slide and a barrel, the slide and barrel being relatively movable and having means for locking the slide and barrel together.

2. Description of the Prior Art

Handguns in the form of automatic pistols are well-known in the prior art. Typically, these firearms have a slide and a barrel which is relatively movable relative to the slide. When firing the barrel is locked to the slide, cartridges may be fed from a magazine in the grip of the firearm into the barrel in a position for firing when the slide recoils after firing of a cartridge. There is a mechanism which unlocks the connection or relationship between the barrel and the slide to allow the slide to recoil with respect to the barrel. The lock as between the barrel and the slide is the breech lock and is necessary since, without it, upon firing, the barrel would be blown out from its position in the slide.

Typically, in prior art breech lock mechanisms, the locking means for locking the barrel to the slide is in the form of a part or parts having a relationship that a part on the barrel has a transverse or lateral right angle portion that comes into holding engagement with a corresponding transverse or lateral right angle portion on the slide. These parts provide lo king with respect to fore-and-aft relative movement as between the slide and the barrel but do not resist lateral relative movement or vibration.

It is significant that in respect of military weapons of the type referred to, the parts as identified that provide for breech locking are manufactured with relatively large tolerances. This is necessary in a military weapon because such weapon has to remain operative even if it has been exposed to mud, dust, mishandling or otherwise. If tolerances were made too precise, mud or sand getting into the spaces between the parts identified could render the weapon inoperative. On the other hand, with target firearms or weapons, the tolerances as between the parts that have been identified can be made much smaller, and accordingly, the parts fit with greater precision and the result is that the firearm or weapon is more accurate.

The foregoing identifies a deficiency in the prior art, particularly with respect to firearms of the type described. The herein invention is concerned with providing an improvement overcoming the described deficiency, a preferred embodiment of the invention being described in detail hereinafter.

SUMMARY OF THE INVENTION

A preferred embodiment of the invention is disclosed herein, wherein the invention is embodied in an automatic pistol having a slide and a barrel within the slide, these parts being relatively movable. When the firearm is fired, the slide recoils rearwardly. The firearm includes a mechanism whereby when the slide moves rearwardly, the breec lock locking the barrel to the slide is released to allow relative movement between the slide and the barrel. The barrel at the rear end moves downwardly slightly to unlock or disengage from the locked relationship between the barrel and the slide, and the slide recoils rearwardly.

The slide has an opening in its upper surface which is positioned over the rear part of the barrel. The rear part of the barrel has an upper conformation or configuration which can move up into the opening or recess in the upper part of the slide when the rear part of the barrel is raised when the slide is moved forwardly after firing. The slide recoils against the force of a spring which returns the slide after firing.

In the preferred form of the invention, the recess in the upper part of the slide has a particular configuration at the forward part which preferably is in the form of a V-shaped notch. The confirmation or configuration at the upper part of the rear part of the barrel includes a shaped portion which includes a V-shape notch in the slide. When these parts come together, they serve a very significant function. The engagement of these parts locks the barrel to the slide in firm engagement. These parts are locked against relative fore-and-aft movement, but due to the shape of the inner-fitting parts, the barrel and the slide are firmly and snugly locked against any lateral movement relatively of either part, and the engagement of these parts prevents vibration. Thus, the engagement of these parts as described, for providing a breech lock insures firm engagement between the barrel and the slide so that the precision and accuracy of the firearm or weapon is improved. This is accomplished even though the precision of the tolerances need not be as perfect as is ordinarily necessary in a target-type weapon or firearm. The relationship of the parts accommodates the weapon for use as a military firearm since the weapon or firearm is not as subject to becoming inoperative as a result of being exposed to mud, dust, mishandling or otherwise.

In the light of the foregoing, the primary object of the invention is to realize a simplified, improved and more effective breech lock in a type of weapon of the type described, that is, more particularly, a firearm having a retractable slide and barrel, the slide and the barrel being relatively movable but being locked together for firing.

A further object is to realize an improvement as in the foregoing object wherein the firearm is of the type wherein the slide has an opening or recess in its upper part, the barrel having a rear part which includes a portion that can move upwardly so that this portion comes into the opening or recess in the slide, the engaging parts of the barrel and slide being configured to firmly lock the barrel and slide against relative fore-and-aft movement and against relative lateral movement, vibration or otherwise.

A further object is to realize an improvement as set forth in the foregoing objects wherein the opening or recess in the slide includes a V-notch and the engaging part or portion of the rear part of the barrel includes a V-shaped part or point which snugly engages in the notch provided in the upper part of the slide.

Further objects and advantages of the invention will become apparent from the following detailed description and annexed drawings.

DESCRIPTION OF A PREFERRED EMBODIMENT AND BEST MODE OF PRACTICE

Figure 1:
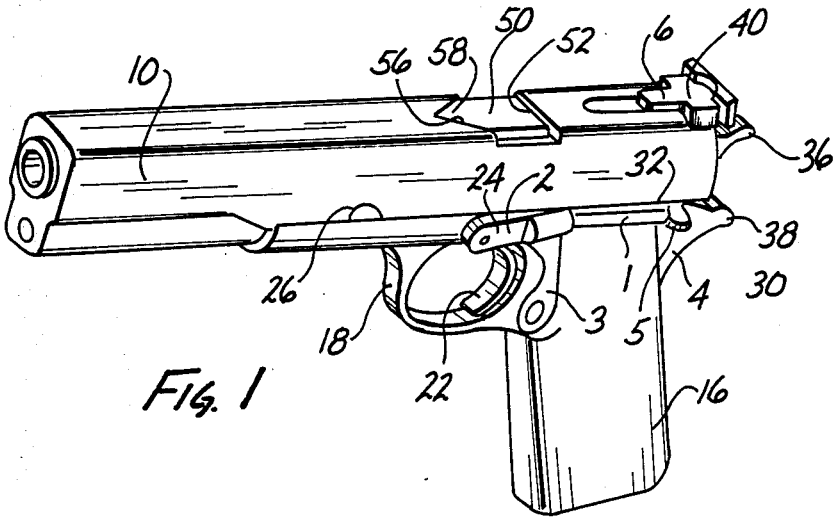
FIG. 1 is an isometric view of an exemplary form of firearm having a preferred embodiment of the invention built into it.

Referring to FIGS. 1, 2, 3 and 4 of the drawings, these figures show an automatic pistol of known general type. The pistol has a slide 10 and a barrel 12. The barrel is movable relative to the slide, the end of the barrel protruding from the end of the slide normally as may be seen in FIG. 1. The barrel and slide will be referred to again presently.

The pistol, of course, has a frame, and it has a handgrip 16. A removal magazine is contained within the grip as is well-known in the art. Cartridges can be dispensed from the magazine and delivered into the breech end of the barrel as is well-known in the art. The frame includes a trigger guard 18, and numeral 22 designates the trigger within the trigger guard. Numeral 24 designates the slide lock which can cooperate with the notch 26 in the slide Numeral 30 designates a safety member which cooperates with notch 32 in the slide. The hammer is designated by the numeral 36, and numeral 38 designates the grip safety with which this type of gun is provided.

The sight is designated by numeral 40 which is mounted to the top of the rear part of the slide 10. The rear part of the barrel is designated by the numeral 42. The bore of the barrel is designated by the numeral 43. The rear part 42 of the barrel extends downwardly from the barrel as may be seen in FIGS. 2 and 4. Numeral 44 designate a link, the upper end of which is pivoted to the lower part 42 of the rear of the barrel 12. This link has pivotal connection to the frame of the gun by way of a pivot pin 46. The upper part of the rear end part 42 of the barrel has an enlarged configuration as designated at 50 which is adapted to come into a position in an opening 52 in the upper part of the slide 10. The opening 52 has a square right angle end part at the rear thereof, and at the forward end thereof, it is formed as a V-notch, as may be seen in the figures. The conformation 50 at the upper part of the rear end part of the barrel 12 has a V-shaped forward extending part as designated at 58. This portion or part of the conformation 50 fits snugly into the V-notch 58 when the barrel and the slide are in locked position for firing. It is to be observed that the locking relationship between the part 50 and the notch 56 securely locks the slide to the barrel against forward movement of the barrel relative to the slide, and these parts are firmly locked together with respect to any relative lateral movement or vibration. This relationship between the parts contributes significantly to the accuracy of the firearm because of the firm holding relationship between the slide and the barrel. Even without extremely precise tolerances in the formation or construction of these parts, the accuracy of the weapon is improved.

Figure 2:
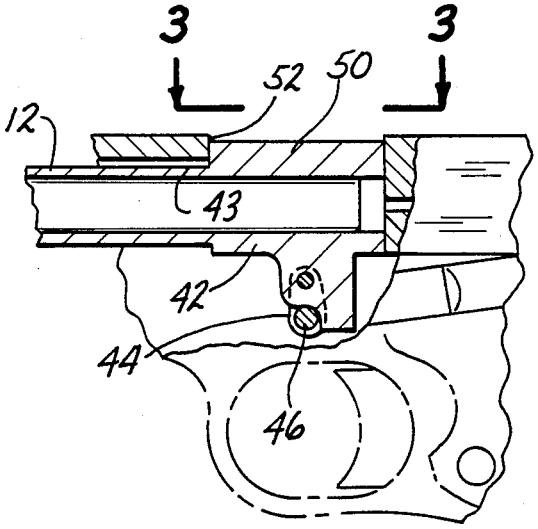
FIG. 2 is a partial cross-sectional view showing the parts of the breech lock of the invention.
Figure 3:
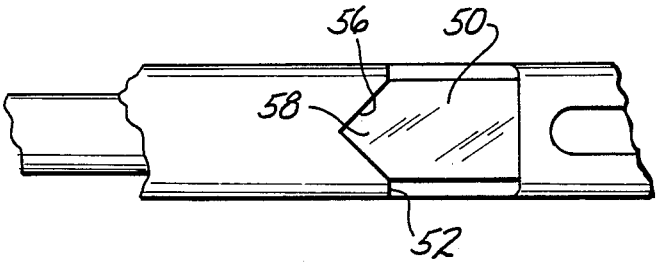
FIG. 3 is a plan view of the part of the firearm illustrated in FIG. 2.
Figure 4:
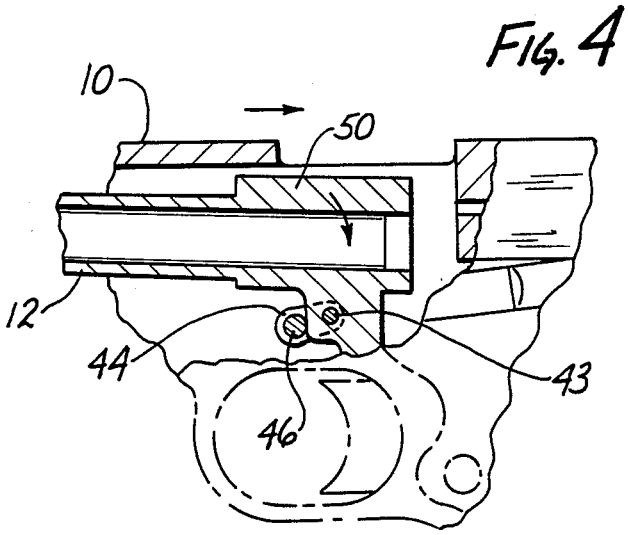
FIG. 4 is a sectional view similar to that of FIG. 2, showing the parts in the breech unlocked position wherein the slide has moved rearwardly relative to the barrel.

With respect to operation, when the slide is retracted, the link connection 44 between the rear end of the barrel and the frame causes the barrel to move from a position as shown in FIG. 2 to that shown in FIG. 4. That is, there is a relative downward movement of the end of the barrel with respect to the slide as the slide recoils rearwardly, the formation 50 moving out of the opening or recess 52 and the slide moving rearwardly with respect to this formation as may be seen in FIG. 4. After recoil, when the slide is again moved forwardly under the influence of a recoil spring, the parts come back into a position as illustrated in FIGS. 1 and 3.

Figure 5:
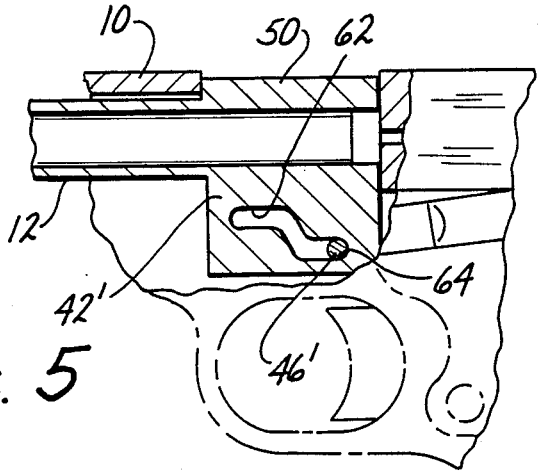
FIG. 5 is a sectional view of a form of the invention utilizing different construction to provide for the relative movement of the slide and the barrel during recoil of the slide.

FIG. 5 illustrates an alternative arrangement with respect to the connection of the barrel to the frame of the gun whereby to produce the relative movements as described in the foregoing. In FIG. 5, the barrel has a rear depending part as designated at 42' which has a slot in it as designated at 62, having a shape as shown, including a forward part, a rear part and a slant part between the forward and rear parts. The slot 62 cooperates with a pin 64 which is affixed to the frame of the gun. In FIG. 5, when the slide is moved rearwardly, the slot 62 moves relatively with respect to the pin 64 so that the rear end of the barrel moves relatively to the slide in the manner already described in connection with FIGS. 1–4.

When the cartridge firing sequence takes place, pressures within the case rise rapidly, driving the bullet forwardly and the cartridge rearwardly. As the cartridge case is restrained by the face of the slide, the resultant forces are forcing the barrel forwardly with respect to the slide. This is being restrained by the taper lock, slide 56 and barrel 58 and results in a positive lock during each firing cycle, reducing the need for critical or close tolerance fits, not only in the lateral direction, but also in a fore-and-aft direction, with respect to the rear of the barrel 50 and the face of the slide 52. With this design, the system is also self-compensating for wear, to a major extent.

Alternative arrangements are possible as known in the art with respect to the connection between the slide and the barrel and the relative movement of these parts.

From the foregoing, those skilled in the art will readily understand the nature and construction of the invention and the manner and mode in which it operates and achieves the objectives as set forth in the foregoing.

The foregoing disclosure is representative of a preferred form of the invention and is to be interpreted in an illustrative rather than a limiting sense, the invention to be accorded the full scope of the claims appended hereto.

What is claim is:

1. In a firearm of the type that has elements including a barrel and a slide, the slide and the barrel being relatively movable, the said elements having portions to provide locking engagement between the slide and the barrel, the said portions including a portion carried by one of the said elements and a portion which is a formation of the other element, the said portions being configured whereby to provide locking engagement between the elements so as to lock in a fore-and aft direction and to also lock with respect to relative lateral movements of the elements, one of the elements including a recess having a shape and the other of the portions having a shape to interfit with said recess, wherein the said recess is of a V-shape and the said formation is of a pointed configuration to fit snugly into the recess.

2. A construction as in claim 1, wherein the rear end of the recess is squarely horizontal and the said formation has a square end shape to bear directly against the rear end of the said recess.

* * * * *